US006712633B2

(12) United States Patent
Tsai

(10) Patent No.: US 6,712,633 B2
(45) Date of Patent: Mar. 30, 2004

(54) ELECTRIC CONNECTOR HAVING LATERAL FASTENERS ARRANGED ALONG AND ROTATABLE ABOUT A HORIZONTAL AXIS

(76) Inventor: Chou Hsuan Tsai, 15F, No. 4, Lane 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/293,011

(22) Filed: Nov. 12, 2002

(65) Prior Publication Data

US 2003/0124897 A1 Jul. 3, 2003

(51) Int. Cl.[7] ..... H01R 4/50; H01R 13/625; H01R 13/62

(52) U.S. Cl. ..... 439/341; 439/157

(58) Field of Search ..... 439/157, 328, 439/153, 325, 327, 541.5, 341

(56) References Cited

U.S. PATENT DOCUMENTS 4,826,447 A * 5/1989 Forker et al. ..... 439/328
5,470,242 A * 11/1995 Cheng et al. ..... 439/157
5,941,723 A * 8/1999 Yu ..... 439/328
5,997,332 A * 12/1999 Choy ..... 439/328

* cited by examiner

*Primary Examiner*—Chandrika Prasad
(74) *Attorney, Agent, or Firm*—Pro-Techtor International Services

(57) ABSTRACT

An electric connector includes an insulation housing formed with a plurality of terminal slots, two positioning slots formed at two sides of the insulation housing, a plurality of terminals inserted into the terminal slots of the insulation housing, respectively, and two lateral fasteners arranged along and rotatable about a horizontal axis, each of which including a main body having a first end engaged with the corresponding positioning slot of the insulation housing. The first end of the main body is formed with an engagement structure. The insulation housing is formed with resilient members within the positioning slots. Each of the resilient members is formed with an engagement block. When the lateral fastener is inserted into the positioning slot, the engagement block engages with the engagement structure of the lateral fastener.

5 Claims, 4 Drawing Sheets

ELECTRIC CONNECTOR HAVING LATERAL FASTENERS ARRANGED ALONG AND ROTATABLE ABOUT A HORIZONTAL AXIS

BACKGROUND OF THE INVENTION

1. Field of the Invention

The invention relates to an electric connector, and in particular to an electric connector having lateral fasteners at two sides of the connector.

2. Description of the Related Art

Referring to FIG. 1, a conventional electric connector includes an insulation housing 11, a plurality of first terminals 12, a plurality of second terminals 13, and two lateral fasteners 14. The first terminals 12 are arranged in the front terminal slots of the insulation housing 11, and have pins horizontally located on the bottom surface of the insulation housing 11. The second terminals 13 are arranged in the rear terminal slots of the insulation housing 11, and have pins horizontally located on the bottom surface of the insulation housing 11. The levels of the pins of the first terminals 12 and the second terminals 13 are the same. Two lateral fasteners 14 are mounted and positioned at two lateral sides of the insulation housing 11. Each lateral fastener 14 has a positioning surface 141 having the same level as those of the first and second terminals 12 and 13.

The lateral fasteners 14 are mounted to the insulation housing 11 by way of press fitting. However, the combination method does not have good effects because the combination strength is not good and the insulation housing 11 may be damaged.

In addition, the pins of the first and second terminals 12 and 13 as well as the positioning surfaces 141 of the lateral fasteners 14 are bonded to a circuit board, so the levels of the pins and the positioning surfaces 141 have to be the same. Since the lateral fasteners 14 are quite long, it is difficult to control the positioning surfaces 141 and the first and second terminals 12 and 13 to be located at the same level. Therefore, more precise manufacturing processes may be required, thereby increasing the manufacturing cost.

SUMMARY OF THE INVENTION

It is therefore an object of the invention to provide an electric connector having two lateral fasteners to be easily and firmly positioned in the insulation housing without damaging the insulation housing.

Another object of the invention is to provide an electric connector in which two lateral fasteners are pivotally mounted, so as to facilitate the adjustment of the positions of the positioning surfaces of the lateral fasteners. After the proper adjustment, the pins of the terminals and the positioning surfaces may be at the same level.

To achieve the above-mentioned objects, the invention discloses an electric connector. The electric connector includes an insulation housing formed with a plurality of terminal slots, two positioning slots formed at two sides of the insulation housing, a plurality of terminals inserted into the terminal slots of the insulation housing, respectively, and two lateral fasteners, each of which including a main body having a first end engaged with the corresponding positioning slot of the insulation housing. The first end of the main body is formed with an engagement structure. The insulation housing is formed with resilient members within the positioning slots. Each of the resilient members is formed with an engagement block. When the lateral fastener is inserted into the positioning slot, the engagement block engages with the engagement structure of the lateral fastener.

According to the above-mentioned structure, when the main body of the lateral fastener is inserted into the positioning slot of the insulation housing for positioning, the resilient member may be shifted away. After the main body enters the positioning slot, the engagement structure is engaged with the projection of the resilient member. Due to the formation of the slant guide surface of the projection in conjunction with elasticity of the resilient member, the assembling processes are quite easy, and the engagements are quite firm. Therefore, no further force has to be exerted for press fitting, and the insulation housing is free from being damaged.

DETAILED DESCRIPTION OF THE INVENTION

Figure 1:
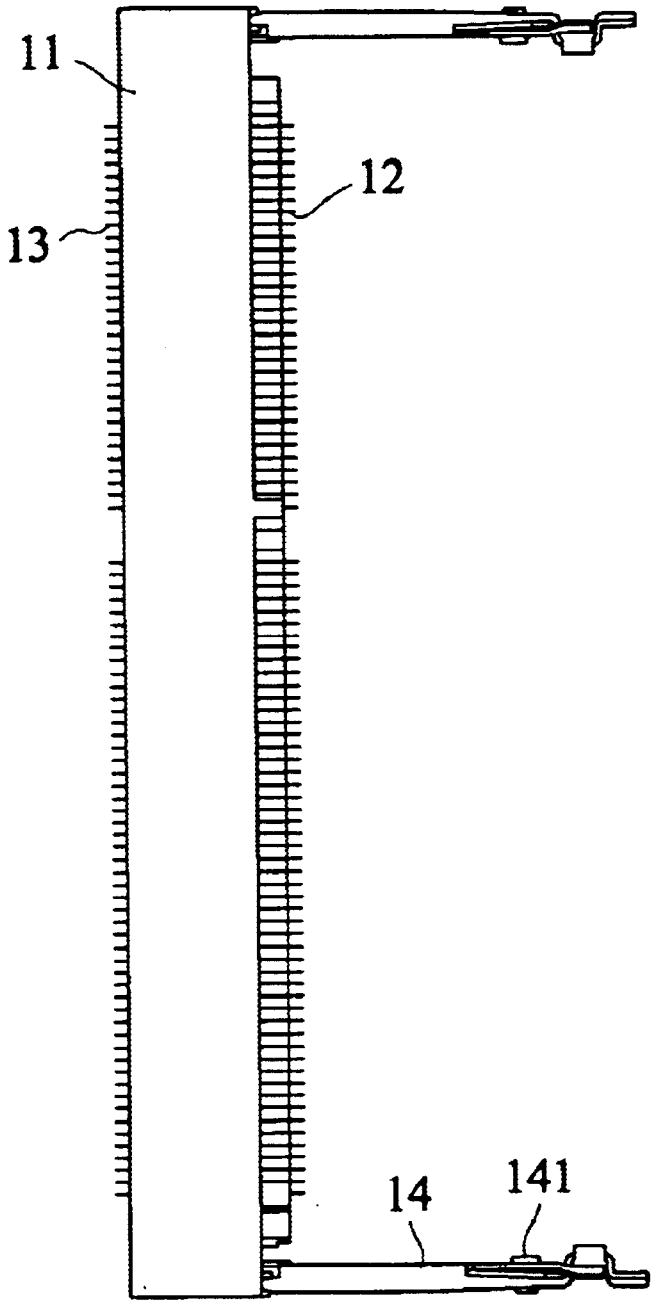
FIG. 1 (PRIOR ART )
FIG. 1 is a top view showing a conventional electric connector.
Figure 3:
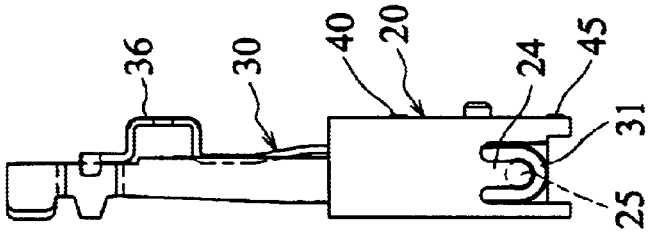
FIG. 3 is a side view showing the electric connector according to the embodiment of the invention.
Figure 2:
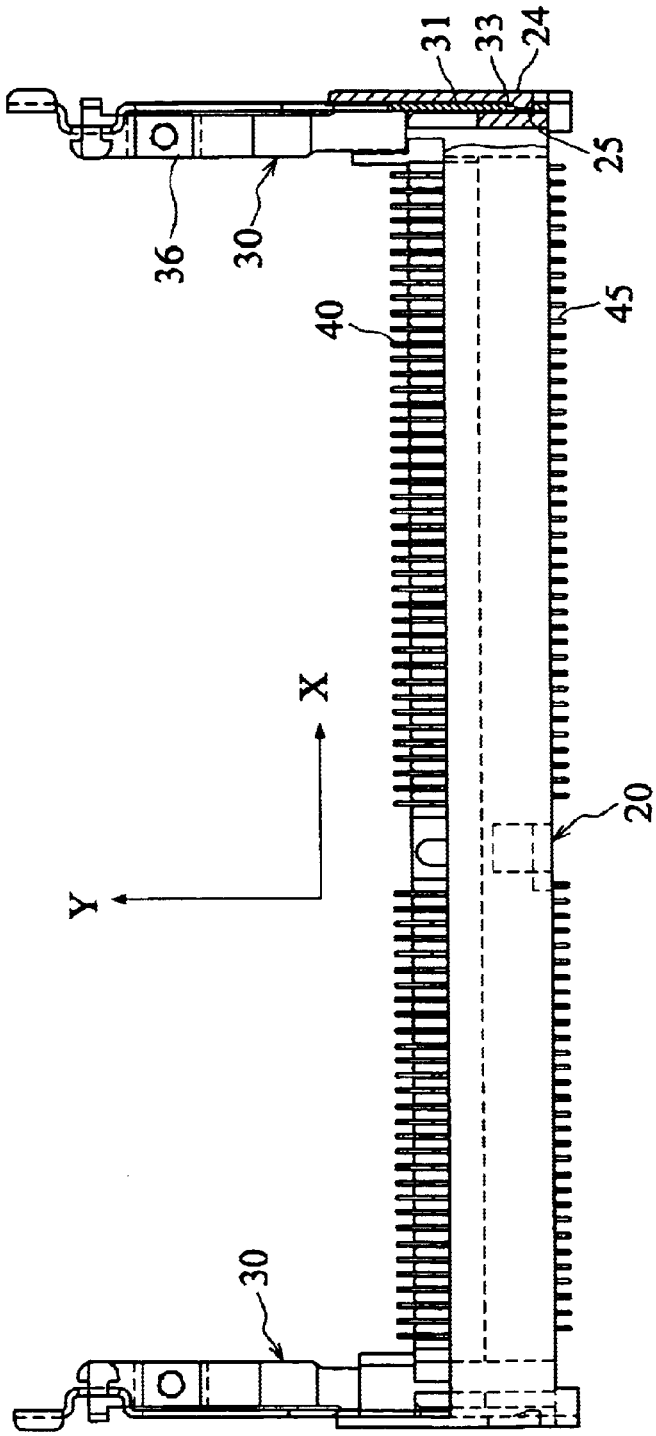
FIG. 2 is a top view showing an electric connector according to the preferred embodiment of the invention.

Referring to FIGS. 2 and 3, an electric connector according to a preferred embodiment of the invention includes an insulation housing 20, a plurality of first terminals 40, a plurality of second terminals 45, and two lateral fasteners 30 arranged along a horizontal axis X.

Figure 4:
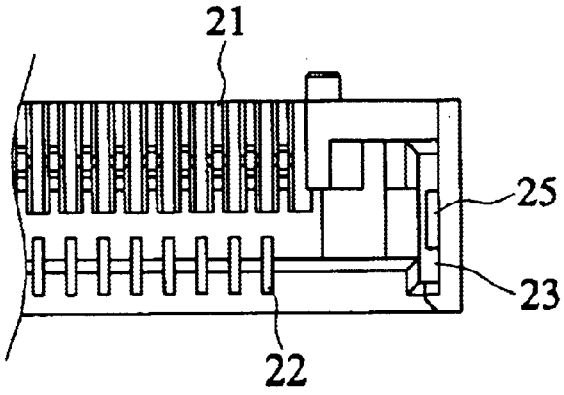
FIG. 4 is front view showing the electric connector according to the embodiment of the invention.
Figure 5:
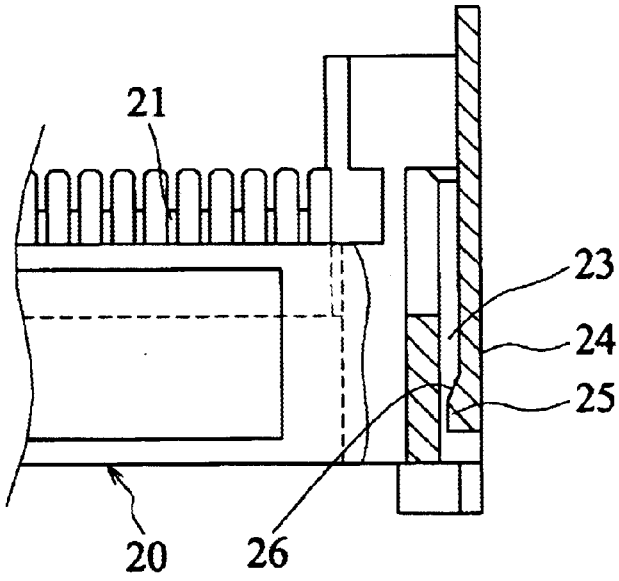
FIG. 5 is a top view showing the insulation housing according to the embodiment of the invention.
Figure 6:
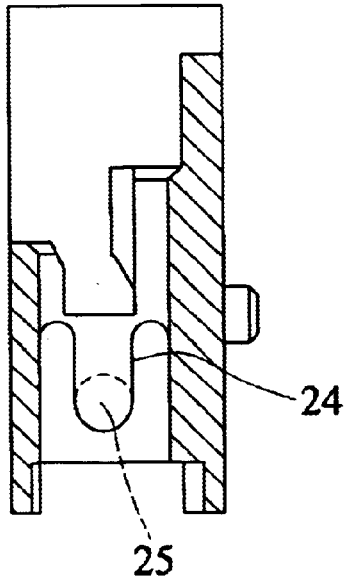
FIG. 6 is a side view showing the insulation housing of the invention.

Referring to FIGS. 4 to 6 correspondingly, the insulation housing 20 is formed with a row of first terminal slots 21 arranged along the horizontal axis X and a row of second terminal slots 22 arranged along the horizontal axis X. The row of first terminal slots 21 may be defined as a lower front row, while the row of second terminal slots 22 may be defined as an upper rear low. Two positioning slots 23 are formed at two sides of the connector and arranged along the horizontal axis X. A resilient member 24 is provided at one side of the positioning slot 23. An engagement block such as a projection 25 is formed at the inner side of the resilient member 24. The projection 25 has a slant guide surface 26.

The first terminals 40 arranged along the horizontal axis X are inserted into the first terminal slots 21 of the insulation housing, respectively, and have pins horizontally positioned on the bottom surface of the insulation housing 20.

The second terminals 45 arranged along the horizontal axis X are inserted into the second terminal slots 22 of the insulation housing, respectively, and have pins horizontally positioned on the bottom surface of the insulation housing 20.

Figure 7:
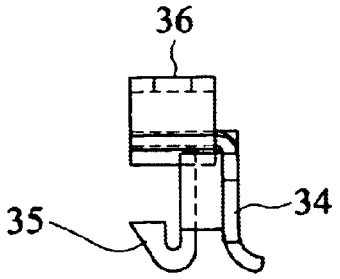
FIG. 7 is a front view showing the lateral fastener of the invention.
Figure 8:
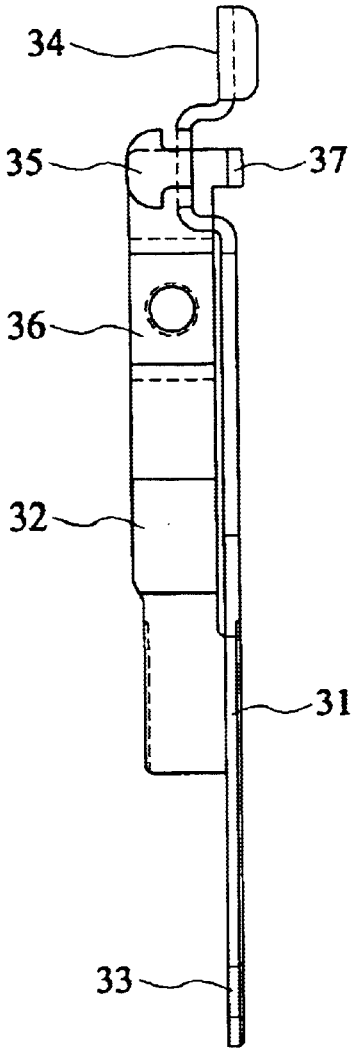
FIG. 8 is a top view showing the lateral fastener of the invention.
Figure 9:
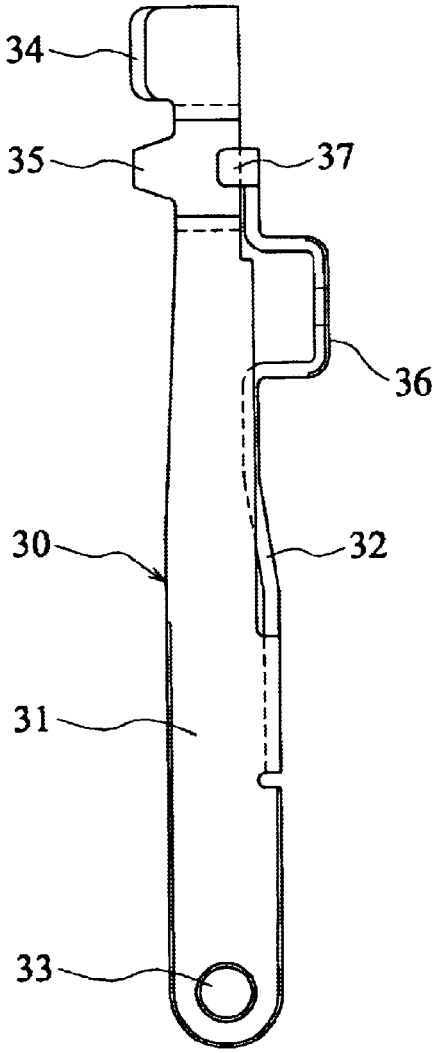
FIG. 9 is a side view showing the lateral fastener of the invention.

Referring to FIGS. 7 to 9 correspondingly, each lateral fastener 30 includes a main body 31. The main body 31 has a first end formed with an engagement structure, which may be a circular engagement hole 33. The main body 31 also has a second end, which is opposite to the first end and formed with a handle 34 and a protruding fastener member 35. The main body 31 has a sub-body 32 extending from a side thereof. The sub-body 32 is formed with a positioning surface 36 and a stopper 37. The stopper 37 is positioned at an external side of the main body 31 in order to prevent the main body 31 from being over-shifted externally. The fastener members 35 are used to fasten a circuit board to the electric connector at engaging holes (not shown) formed at two sides of the circuit board. The main body 31 of the lateral fastener 30 is inserted into the positioning slot 23 of the insulation housing 20. The projection 25 may engage with the engagement hole 33 of the lateral fastener 30. The positioning surface 36 is positioned at the bottom end or lower side of the lateral fastener 30, and the level of the positioning surface 36 is the same as those of the pins of the first and second terminals 40 and 45.

According to the above-mentioned structure, when the main body 31 of the lateral fastener 30 is inserted into the positioning slot 23 of the insulation housing for positioning, the resilient member 24 may be shifted away. After the main body 31 enters the positioning slot 23, the engagement hole 33 is engaged with the projection 25 of the resilient member 24. Due to the formation of the slant guide surface 26 of the projection 25 in conjunction with elasticity of the resilient member 24, the assembling processes are quite easy, and the engagements are quite firm. Therefore, no further force has to be exerted for press fitting, and the insulation housing is free from being damaged.

The reasons for the easy assembly of the lateral fastener of the invention will be described in the following. During assembly, the engagement structure of the lateral fastener enters the positioning slot of the insulation housing under a relaxed state. Then, the engagement process is done by way of the elastic motion of the resilient member of the insulation housing, thereby simplifying the assembling processes.

Furthermore, when the engagement hole 33 is a circular hole, the main body 31 of the lateral fastener 30 may be rotated about the projection 25 of the insulation housing 20 serving as a pivotal axis. Accordingly, the position of the positioning surface 36 may be adjusted by the rotation of the main body 31 so that the pins of the first and second terminals 40 and 45 may be located at the same plane. That is, the main body 31 of the lateral fastener 30 may be rotated about the horizontal axis X so that the positioning surface 36 of the fastener 30 may be located at the same level as the pins of the terminals 40 and 45 because the projector 25 serving as the pivotal axis is extended along the horizontal axis X, as shown in FIG. 2.

Since the lateral fastener of the invention may be rotated according to the design choice, a vertical movement of the fastener may be adjusted, and the manufacturing tolerance may be well treated. Therefore, the requirement of making the lateral fasteners and the terminals at the same plane may be easily satisfied.

In the above-mentioned embodiment, the engagement structure of the lateral fastener includes an engagement hole to be engaged with the engagement block (projection) of the resilient member of the insulation housing. However, if the engagement structure of the lateral fastener is designed to be a projection, a recess or a through hole for engagement may be formed at the middle of the engagement block of the resilient member of the insulation housing.

While the invention has been described by way of an example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. An electric connector, comprising:

an insulation housing formed with a plurality of terminal slots arranged along a horizontal axis;

two positioning slots formed at two sides of the insulation housing and arranged along the horizontal axis;

a plurality of terminals inserted into the terminal slots of the insulation housing, respectively, the terminals being arranged along the horizontal axis, and each of the terminals having a pin horizontally located on a bottom surface of the insulation housing; and two lateral fasteners, each of which including a main body having a first end engaged with a corresponding one of the positioning slots of the insulation housing, the lateral fasteners being arranged along the horizontal axis, and each of the lateral fasteners having a positioning surface at a lower side thereof, wherein, the first end of the main body is formed with an engagement structure, the insulation housing is formed with resilient members within the positioning slots, each of the resilient members is formed with an engagement block, when the lateral fastener is inserted into the positioning slot, the engagement block engages with the engagement structure of the lateral fastener, and the main body of the lateral fastener may be rotated about the horizontal axis so that the positioning surface of the fastener may be located at the same level as the pins of the terminals.

2. The electric connector according to claim 1, wherein the engagement block of the insulation housing is a projection, and the engagement structure of each of the lateral fasteners is an engagement hole.

3. The electric connector according to claim 2, wherein the projection is formed with a slant guide surface.

4. The electric connector according to claim 2, wherein the engagement hole of the lateral fastener is a circular hole, and the main body of the lateral fastener may be rotated about the projection of the insulation housing serving as a pivotal axis.

5. The electric connector according to claim 1, wherein the main body of the lateral fastener has a second end, which is opposite to the first end and formed with a protruding fastener member.

* * * * *